US006389598B1

(12) United States Patent
Westers et al.

(10) Patent No.: US 6,389,598 B1
(45) Date of Patent: May 21, 2002

(54) SEALABLY ACCESSIBLE WADER SYSTEM

(76) Inventors: John M. Westers; Elisabeth Higbee Westers, both of 2914 Bassick, Fort Collins, CO (US) 80526

( * ) Notice: Subject to any disclaimer, the term of this patent is extended or adjusted under 35 U.S.C. 154(b) by 0 days.

(21) Appl. No.: 09/992,039

(22) Filed: Nov. 21, 2001

Related U.S. Application Data

(60) Provisional application No. 60/252,606, filed on Nov. 21, 2000.

(51) Int. Cl.[7] ..... A41D 13/00
(52) U.S. Cl. ..... 2/82; 2/69
(58) Field of Search ..... 2/82, 69, 79, 81, 2/2.15–2.17, 227, 234, 270, 400, 403, 405

(56) References Cited

U.S. PATENT DOCUMENTS 291,854 A * 1/1884 Platt
1,488,536 A * 4/1924 Fry
2,853,758 A * 9/1958 Topf
4,274,159 A * 6/1981 Schmidt
4,568,340 A * 2/1986 Giacalone ..... 2/405 X
4,604,761 A * 8/1986 Wright
4,667,344 A * 5/1987 Cooper, III
5,159,719 A * 11/1992 Aumann
5,210,879 A * 5/1993 Miller
5,444,898 A * 8/1995 Norvell
5,548,842 A * 8/1996 Wiseman, Sr.
5,924,172 A * 7/1999 Klein
6,049,913 A * 4/2000 Harrigan, Jr.
6,092,266 A * 7/2000 Lee
6,105,214 A * 8/2000 Press
6,223,349 B1 * 5/2001 Roiser

OTHER PUBLICATIONS

U.S. Provisional application No. 60/252,606, filed Nov. 21, 2000, entitled "Wader Fly—Removable Cover System".*

* cited by examiner

*Primary Examiner*—Gloria M. Hale
(74) *Attorney, Agent, or Firm*—Santangelo Law Offices, P.C.

(57) ABSTRACT

An outerwear system having sealable access through which objects can be transferred between the outside and the inside of the outerwear. Specifically, a wader system that allows the male wearer to urinate without having to remove the wader or to draw the wader down.

27 Claims, 21 Drawing Sheets

19/21

SEALABLY ACCESSIBLE WADER SYSTEM

This application claims the benefit of U.S. Provisional Patent Application No. 60/252,606, filed Nov. 21, 2000, hereby incorporated by reference herein.

BACKGROUND OF THE INVENTION

Generally, an outerwear system having a sealable access through which objects can be transferred between the outside and the inside. Specifically, a wader system that allows the wearer to urinate without having to remove the wader or to draw the wader down.

Outerwear has been manufactured that will protect the wearer from virtually all circumstances, such as pooled liquids, rain, sleet, snow, fog, water spray, flame, molten metals, chemicals, gases, biohazards, or the like, as exemplified by U.S. Pat. Nos. 5,548,842; 6,049,913; 1,488,536; 291,854; and 4,667,344, each incorporated by reference herein. Perhaps, because outerwear is primarily designed to protect the wearer by separating the wearer from the circumstances outside the outerwear, little attention has been given to providing sealable access for the transfer of objects between the outside of the outerwear to the inside of the outerwear.

As such, even though there is a large commercial market for outerwear having sealable access between the inside and the outside of the outerwear, and especially with respect to water proof outerwear, such as waders or other water resistant, or water proof, sports wear, a substantial number of problems remain to be solved.

A significant problem with providing sealable access in outerwear may be that the outerwear is a contiguous piece so that the garment is thoroughly leak-proof as exemplified by U.S. Pat. No. 1,488,536, hereby incorporated by reference. With respect to these types of outerwear, the user steps into, pulls on, or pulls the garment over the human form. Once inside the outerwear the wearer does not have any sealable access between the outside and the inside of the outerwear for the transfer or the extension of objects.

Another significant problem with providing sealable access in outerwear may be that the outerwear has a separable junction between portions of the outerwear but the separable junction has a closure configured in a fashion that makes opening of the separable junction impracticable, inconvenient, or impossible for the wearer as exemplified by U.S. Pat. Nos. 2,853,758; 6,223,349; and 5,159,719, hereby incorporated by reference herein.

Another significant problem with providing sealable access in outerwear may be that the separable junction in the outerwear has a closure that does not provide a leak-proof seal at the separable junction as exemplified by U.S. Pat. Nos. 291,854; 6,105,214; 5,924,172; 4,667,344; 5,548,842 and 5,444,898.

Another significant problem with providing sealable access in outerwear may be that the closure at a separable junction may not be a discrete component from the material of the outerwear itself. As exemplified by U.S. Pat. Nos. 4,274,159; and 5,210,879, a "folded" or "rolled" extendible "funnel" or "tubular" element provides an conduit that communicates from the inside of the outerwear to the outside of the outerwear. Folded or rolled elements that do not have a removably discrete closure may present a number of inconveniences for the wearer. First, an unfolding or unrolling duration of time elapses in creation of the conduit from the inside to the outside of the outerwear. Using the folded or rolled funnel or tubular type components may be particularly difficult, impracticable, or impossible when the wearer is holding other objects, such as sporting equipment or tools, or when the wearer's hands are covered with other outer garments, such as gloves. Again, after use of the funnel or tubular component, there is a folding or rolling duration of time that elapses to seal or to store such funnel or tubular type components.

Additionally, the seal created by compression of a folded or rolled component upon itself may vary in resistance to penetration by liquid depending on how the folded or rolled components are manipulated. The seal created by folding or rolling the funnel or tubular component may occur only after a number of rolls or folds, at varying points in the rolling or folding process, or not at all, and all without certainty from the viewpoint of the wearer. Moreover, the seal created by folding or rolling a funnel or tubular component may come undone due to the resiliency of the material the funnel or tubular element is made of, subsequent movement of the outer garment transferred to the seal surfaces, or failure of the covering or retention element holding the funnel or tubular element in the folded or rolled configuration.

When tubular or funnel type components are configured for elimination of excretory waste, such as urination by male users as exemplified by U.S. Pat. Nos. 4,274,159; and 5,210,879, hereby incorporated by reference herein, there may be additional problems. Once tubular or funnel type components are unfolded or unrolled the penile organ must be extended through a length of rollably or foldably flexible material that may not have selectably adjustable length. Once and if accomplished, tubular or funnel shaped flexible materials may also collect urine and transfer urine to the inside of the outerwear or may also have urine accumulate on them.

Another significant problem with providing sealable access in outerwear may be the lack of an access location adjustment element. Under certain circumstances the access conduit that communicates between the inside of the outerwear and the outside of the outer wear must be juxtaposed with a location on the wearer's body, a container inside the outerwear, or other object(s) inside the outerwear. Outerwear may lack an affirmative grip that is responsive to the sealable access making positioning of the sealable access relative to the wearer's body, the container, or other object(s) inside the outerwear difficult or impossible.

Another significant problem with providing sealable access in outerwear may be the lack of a thermal barrier between the exterior of the access element and the interior of the access element. As such, the access element may transfer heat to the exterior of the outerwear at a rate that makes contact with the access element uncomfortable to the wearer.

Yet another significant problem with providing sealable access in outerwear may be the lack of friction enhancement surfaces on the sealable access. The lack of friction enhancement surfaces may make the sealable access difficult to manipulate or position.

Still another significant problem with providing sealable access in outerwear may be the lack visual indicia to make observation, location, or manipulation of the sealable access less difficult. This is particularly true when the outerwear is bulky or makes the movement of the wearer within more difficult.

As to each of the above-mentioned problems with providing sealably accessible outerwear and in particular a sealably accessible wader system, the various embodiments of the invention provide practical solutions.

SUMMARY OF THE INVENTION

A broad object of the invention can be to provide sealably accessible outerwear having an access that communicates between the inside and the outside of the outerwear. The access may be located as desired on the surface of the outerwear allowing the transfer of or extension of a variety of objects between the interior of the outerwear to the exterior of the outerwear.

A significant object of embodiments of the invention can be to provide a sealable access that does not utilize a seal resulting from folding or rolling of the access element itself or the material surrounding the access element, but rather provides a removably discrete closure element. One aspect of this object can be to provide embodiments of the invention that eliminate the variation in the seal generated at the access element resulting from rolling or folding of a tubular element or funnel element joined to the access element. A second aspect of this object can be to eliminate or limit the duration of time necessary to seal or unseal the access element.

Another significant object of embodiments of the invention can be to provide sufficient compression between the closure element and the access element to provide a waterproof seal.

Another significant object of embodiments of the invention can be to provide access elements that can be positioned at a selectable distance from the outside surface of the outerwear.

Another significant object of embodiments of the invention can be to provide surfaces that facilitate the visualization of or manipulation of the various embodiments of access element or closure elements.

Another significant object of embodiments of the invention can be to provide sealing elements that compressibly conforms to irregularities in the various embodiments of the access elements or the closure elements.

Another significant object of embodiments of the invention can be to provide waterproof wader outerwear having a sealable access in the crotch area to allow a male wader wearer to urinate without removing or pulling the wader down.

Naturally, further independent objects of the invention are disclosed throughout other areas of the specification and drawings.

DETAILED DESCRIPTION OF THE PREFERRED EMBODIMENTS

The invention involves outerwear having a sealable access that provides a conduit from inside of the outerwear to outside of the outerwear. While particular embodiments of the sealably accessible outerwear invention are exemplified in the context of a wader system, it should be understood that the embodiments of the invention shown by the figures along with the examples described are intended to be illustrative of the great variety of outerwear embodiments of the invention, including but not limited to, waterproof outer garments, water resistant outer garments, outdoor sports wear, foul weather garments, rubber clothing, aquatic sports suits, protective garments, or the like, whether for men or for women. Moreover, while a number of embodiments of access elements and closure elements are illustrated by figures or by written description, these examples along with any permutations or combinations, are not intended to be limiting with regard to the great variety of access elements or closures encompassed by embodiments of the generic invention(s) claimed.

Figure 1:
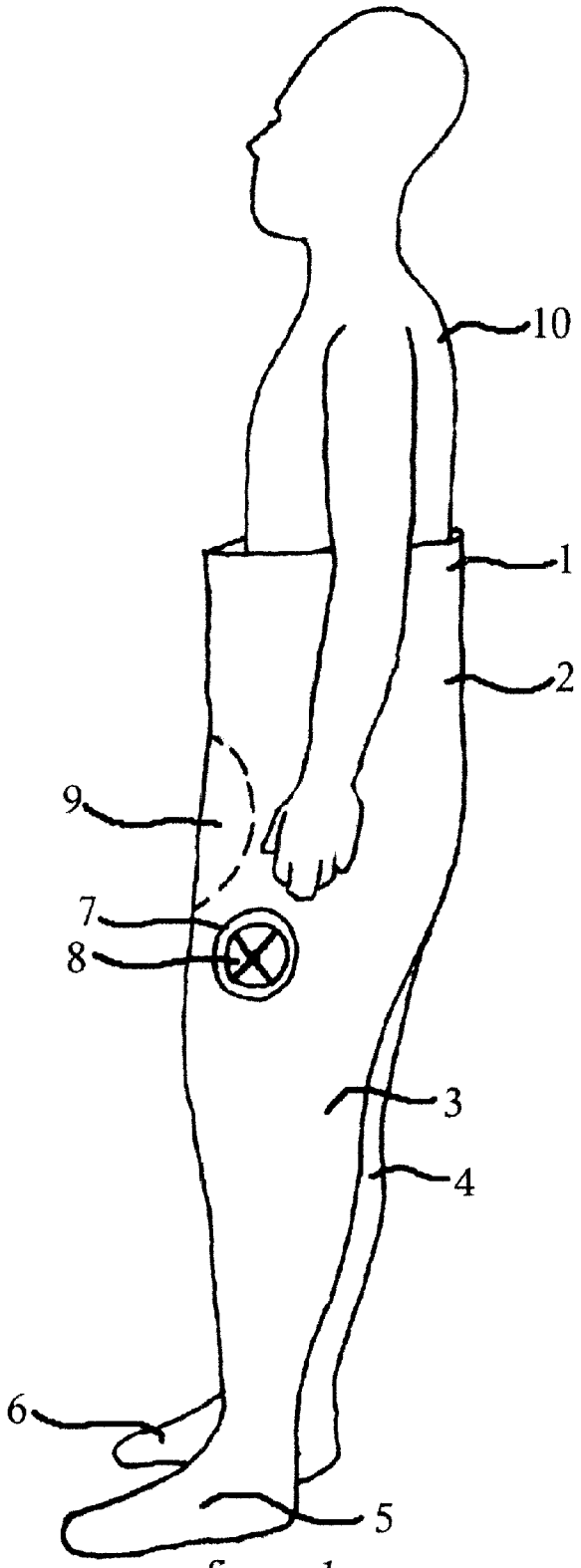
FIG. 1 shows a side view of an embodiment of the sealably accessible outerwear invention having an access element on the leg portion of the outerwear.
Figure 2:
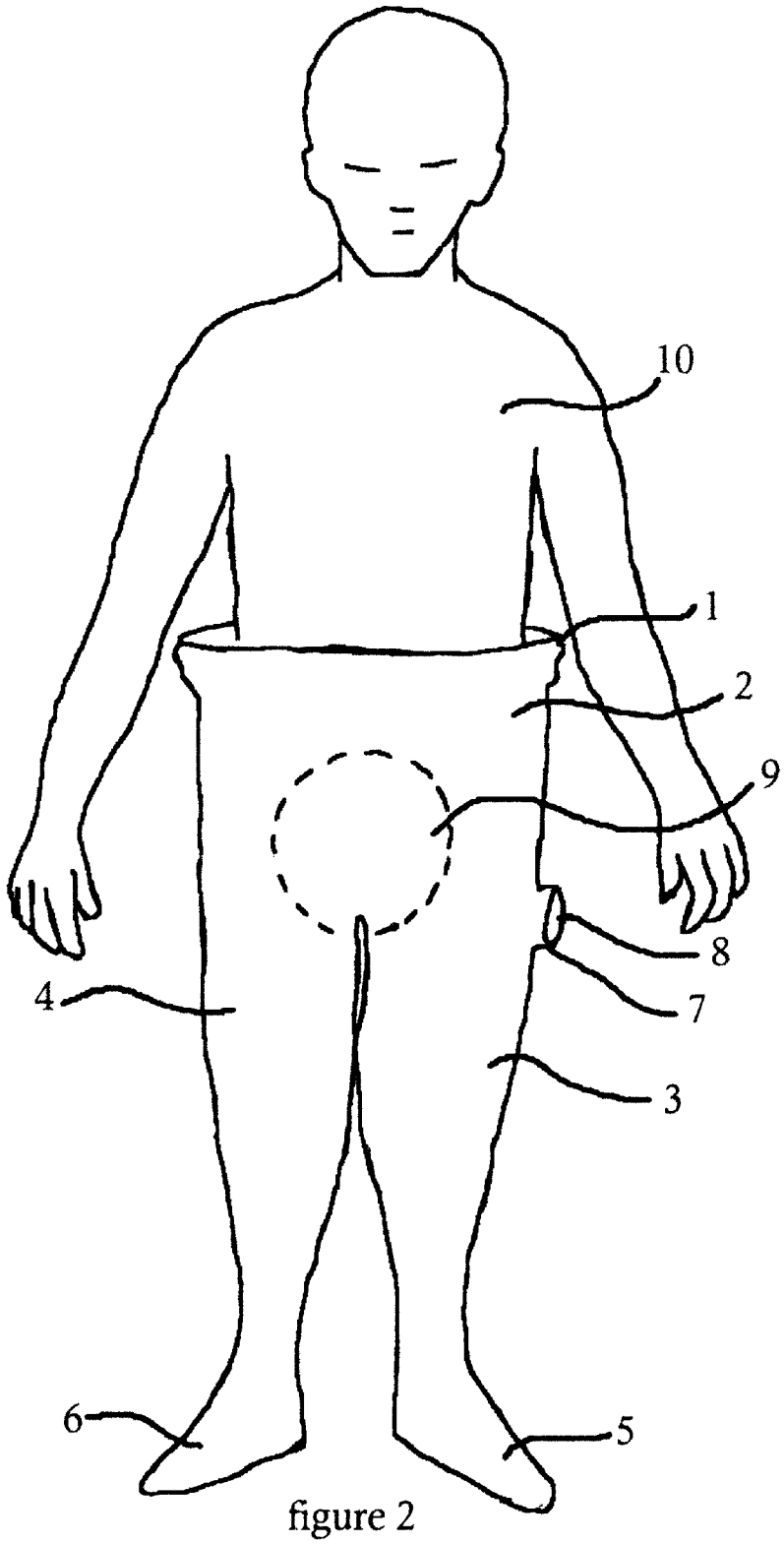
FIG. 2 shows a front view of an embodiment of the sealably accessible outerwear invention having an access element on the leg portion of the outerwear.
Figure 3:
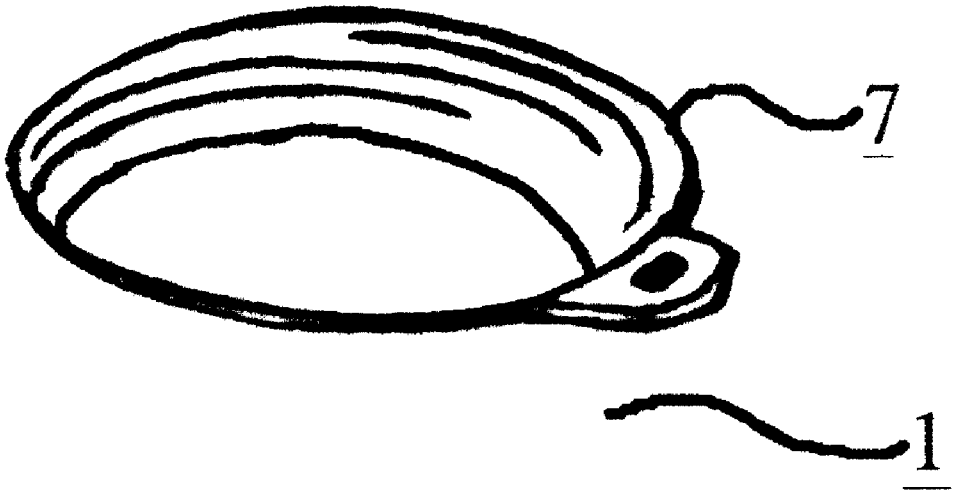
FIG. 3 shows an isometric view of an embodiment of an access element positioned flush with the outside surface of the outerwear.

Now referring primarily to FIGS. 1 through 3, the invention generally involves sealably accessible outerwear (1), including but not limited to, wader outerwear that has a construction substantially impervious to liquid(s). Certain embodiments of the invention can comprise a sealably accessible wader having an upper body portion (2) configured to terminate at a height between about the wader wearer's waist and about the wader wearer's neck, a first leg portion (3) and a second leg portion (4) joined to the upper body portion (2), and a first foot portion (5) and a second foot portion (6) each joined to a corresponding one of the first leg portion (3) and the second leg portion (4). An access element (7) can have a location on the outerwear in the desired area to establish a conduit between the outside of the outerwear and the inside of the outerwear or wader (1). As shown in FIG. 1, the assess element (7) can have a location, for example, in the leg portion of the outerwear (3)(4) and can be used for the transfer of objects between the inside of the outerwear and the outside of the outerwear.

Understandably, there are numerous reasons for locating the access element (7) at certain locations(s) on the surface of the outerwear (1). For example, where containers or pockets are located on the inside of the outerwear (1), the access element (7) may be located so that the contents of such containers or pockets are responsive to the wearer (10) by reaching through the access element (7). In certain other embodiments of the invention, the access element (7) can be located in the crotch area (9) of the outerwear, such as a wader. Where the access element (7) is located in the crotch area (9) of the outerwear, the access element (7) can allow a male penile organ (not shown) to extend from inside of the outerwear (1) to outside of the outerwear (1). This can allow the outerwear wearer (10) to urinate without removal of or drawing down the outerwear (1). This can provide a substantial convenience to the wearer with respect to single piece outerwear, such as fishing waders.

Now referring primarily to FIG. 3, the access element (7) can be positioned substantially flush with the outside surface of the outerwear (1). Importantly, the access element does not necessarily have to be joined to a tubular or funnel shaped portion of the outerwear. Even as to embodiments of the invention that are located in the crotch area (9) of the outerwear (1), a substantially flush access element (7) can allow a male penile organ to extend from inside of the outerwear to the outside of the outerwear (1).

Figure 4:
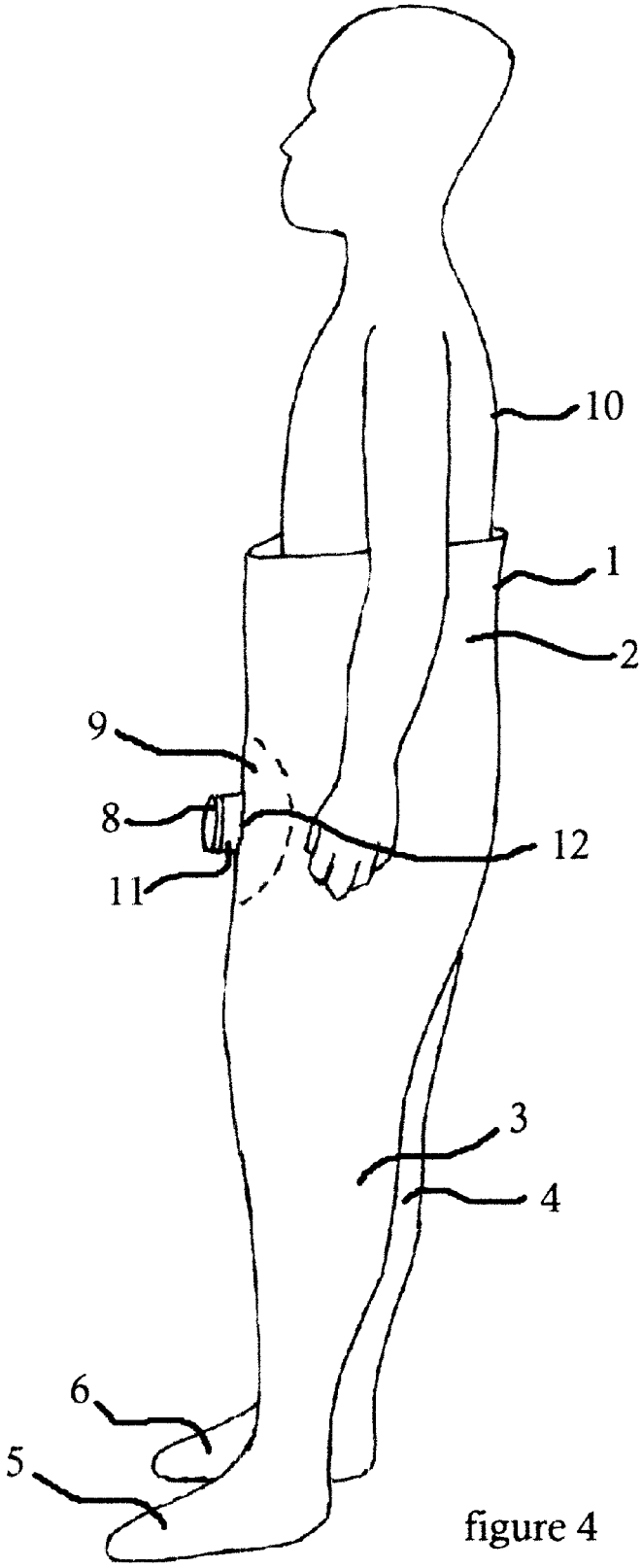
FIG. 4 shows a side view of an embodiment of an access element joined to a tubular element having a location in the crotch area of the outerwear.

Now referring to primarily to FIG. 4, certain embodiments of the invention can further comprise a tubular element (11) having a first end and a second end, where the first end joins to the outerwear (1), such as the wader shown, and the second end joins to the access element (7). In regard to certain embodiments of the invention, the tubular element (7) may have a resiliently flexible or fixed configuration to facilitate the transfer of an object between the inside of the outerwear to the outside of the outerwear. Specifically, with respect to embodiments of the invention that allow a penile organ to be extended through the access element, the tubular element (11) may be configured to facilitate extending the penile organ through the access element (7). This may involve tapering the tubular element (9) as it approaches the access element (7) to help assure that the penile organ has a substantially fixed relationship to the tubular element (9) to prevent or minimize the release of urine to the inside of the outerwear (1).

Figure 5:
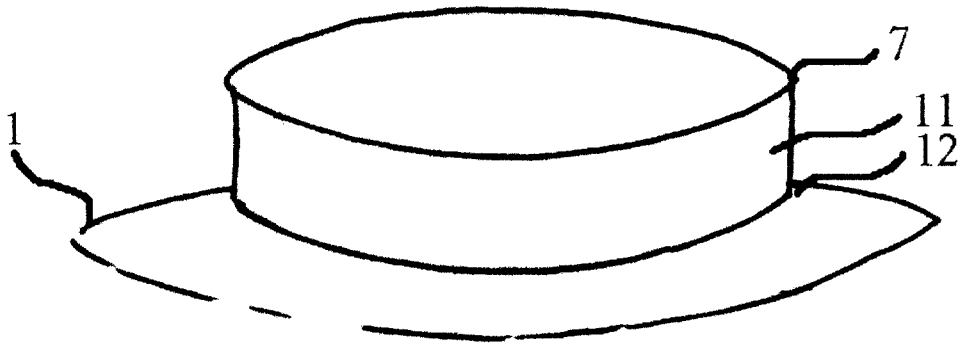
FIG. 5 shows a side view and cross section of an embodiment of an access element joined to a tubular element having a selectably adjustable axial collapse element.
Figure 5:
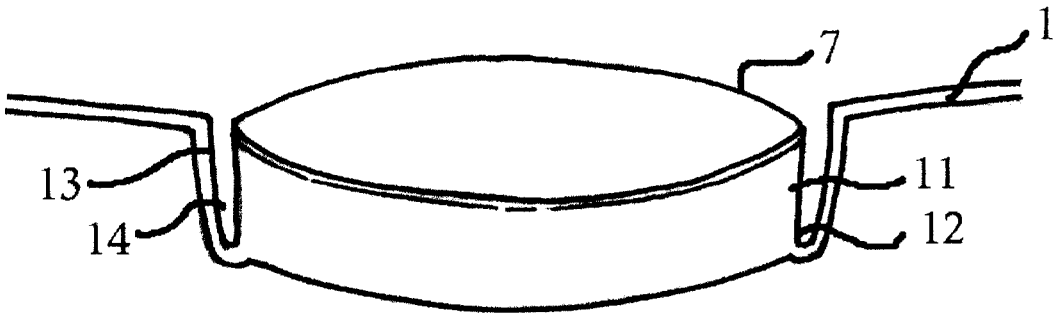

Now referring primarily to FIG. 5, some embodiments of the invention can further comprise an axial collapse element (13) that allows the access element (7) to be positioned at a selected length from the outside surface of the outerwear (1). This may allow the access element (7) to be adjusted to a position between below flush with the surface of the outerwear to several feet from the outside surface of the outerwear (1). The embodiment of the axial collapse element (13), as shown in FIG. 5, can be made from a single layer of flexible material, such as plastic sheet, molded or otherwise formed, to provide a recessed area (14) in which the tubular element (9) can be positioned allowing the access element (7) to be positioned flush with or below flush with the outside surface of the outerwear (1). As further shown in FIG. 5, the axial collapse element (13) can be extended by drawing upon the excess material in the recess area (14) to position the access element (7) a distance from the outer surface of the outerwear (1). Other embodiments of the axial collapse element can comprise an accordion type pleat molded into the material of the tubular element (11), or may involve the use of a extendible support structure coupled to the inside surface, the outside surface, or between layers of a multiple layer material. An example of an extendible structure can be a resiliently flexible coil. The resiliently flexible coil or other extendible support structure can have a particular conformer that it returns to when not in use or at rest.

Now referring primarily to FIGS. 6–19, the access element (7) can be sealed to minimize or prevent material(s) or objects, such as particulates or liquids, from moving between the inside of the outerwear to the outside of the outerwear by engagement of the access element (7) with a closure element (8). The closure element can be removably discrete with respect to some embodiments of the invention. A removably discrete closure element (8) can be disengaged from the access element (7) thereby establishing a separate, discrete access element (7) and a separate discrete closure element (8) for the convenience of the outerwear wearer.

Figure 6:
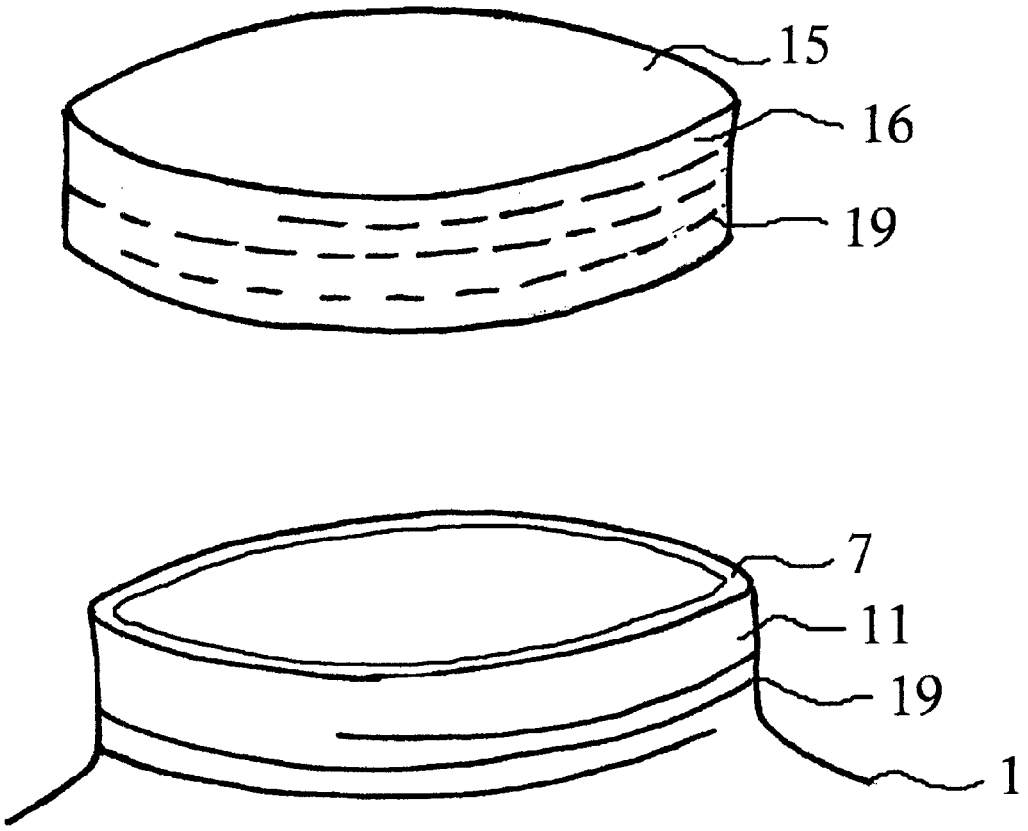
FIG. 6 shows an isometric view of an embodiment of an access element and removably discrete closure element having an embodiment of an axial compression element comprising rotationally mated spiral threads.

As shown in FIG. 6, embodiments of the removably discrete closure invention can comprise a cap (15) having the inside cap surface configured to seal with the access element (7). Certain of the cap embodiments of the removably discrete closure can be configured to fit around the outside of a tubular element (11) a shown in FIG. 6.

Figure 7:
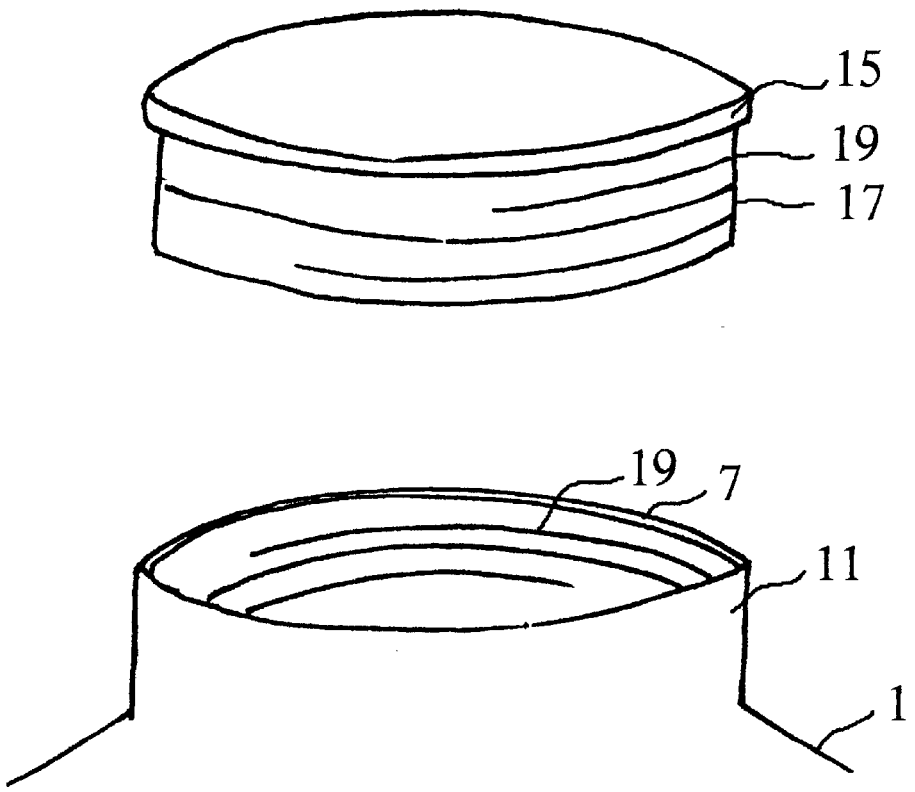
FIG. 7 shows an isometric view of another embodiment of an access element and removably discrete closure element having another embodiment of an axial compression element comprising rotationally mated spiral threads.

As shown in FIG. 7, certain other embodiments of the removably discrete closure invention can be configured to include a plug element (17) that fits inside the tubular element (11) and can form a seal between the outside surface of the plug and the inside surface of the tubular element (11). A radial extension of the plug to prevent or limit further axial movement of the plug into the access element (7) or to further facilitate the formation of a seal can be further included.

Figure 8:
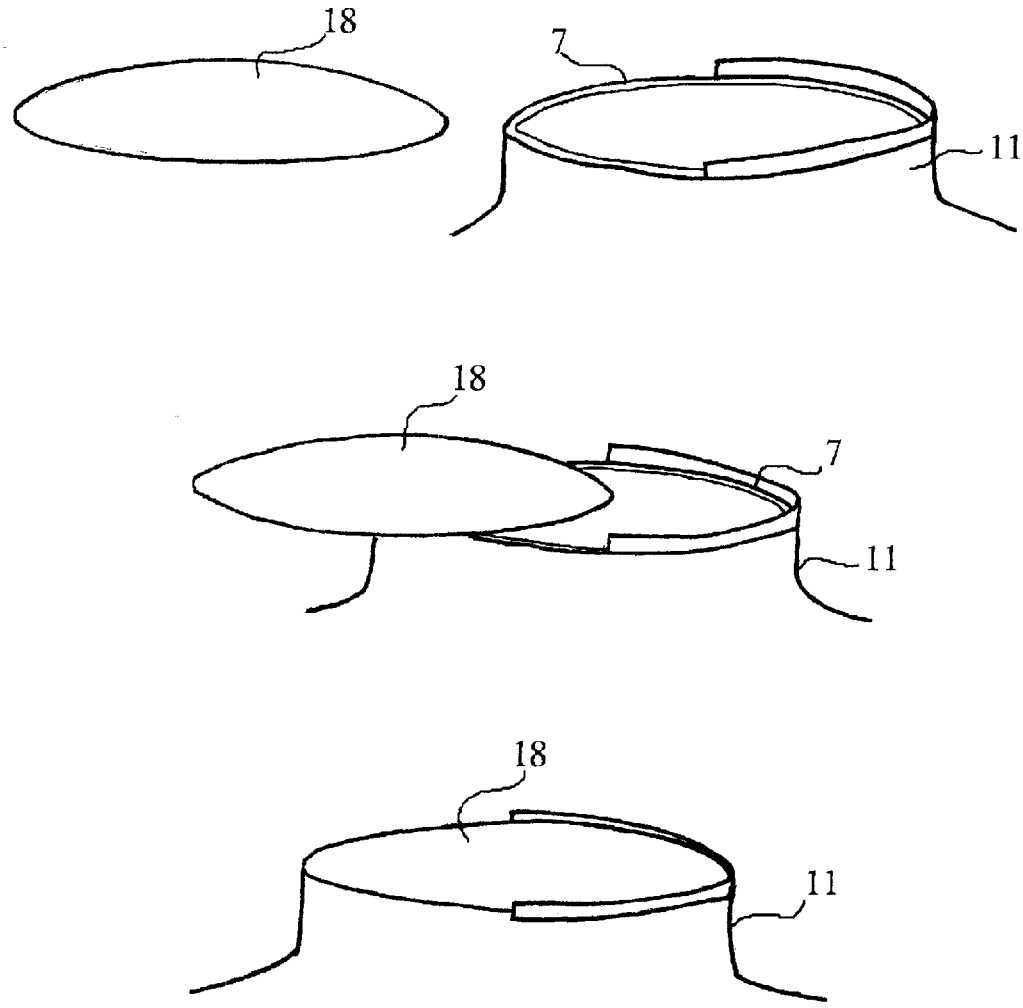
FIG. 8 shows an isometric view of another embodiment of an access element and removably discrete closure element that slidingly engage.
Figure 9:
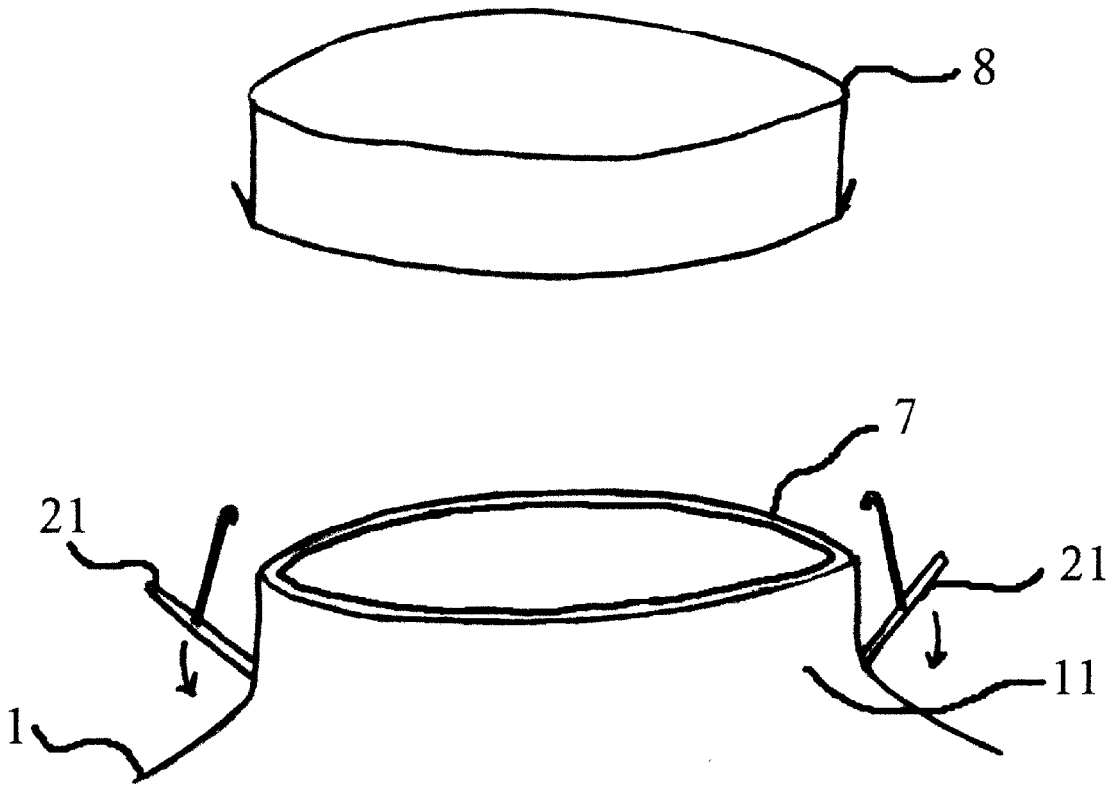
FIG. 9 shows an isometric view of another embodiment of an access element and removably discrete closure element having another embodiment of an axial compression element.
Figure 10:
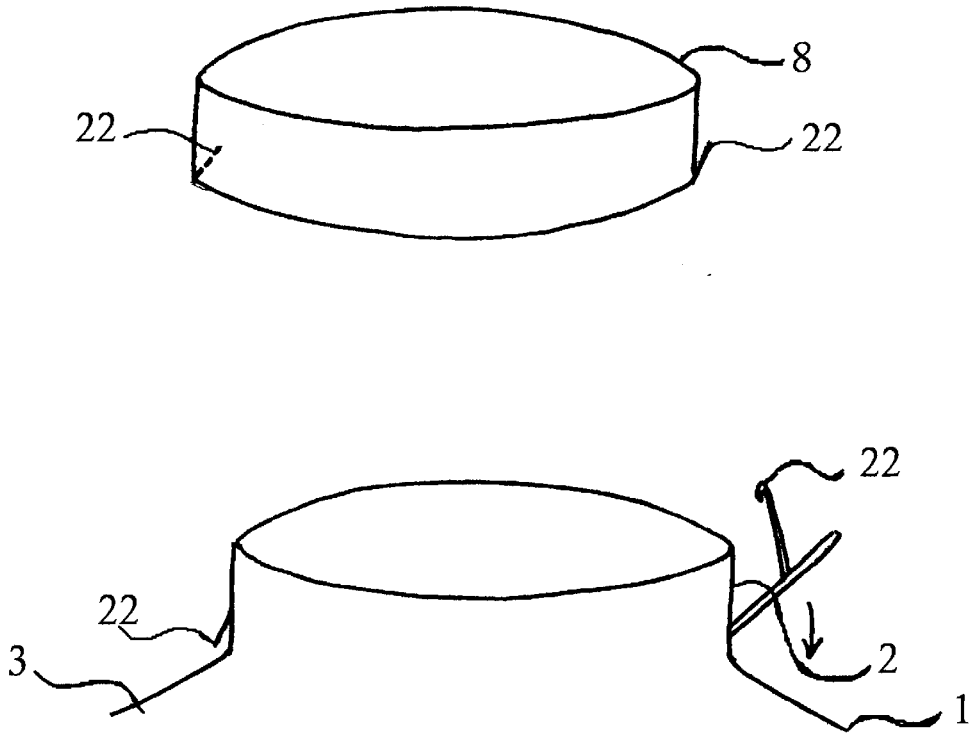
FIG. 10 shows an isometric view of another embodiment of an access element and removably discrete closure element having another embodiment of an axial compression element.
Figure 11:
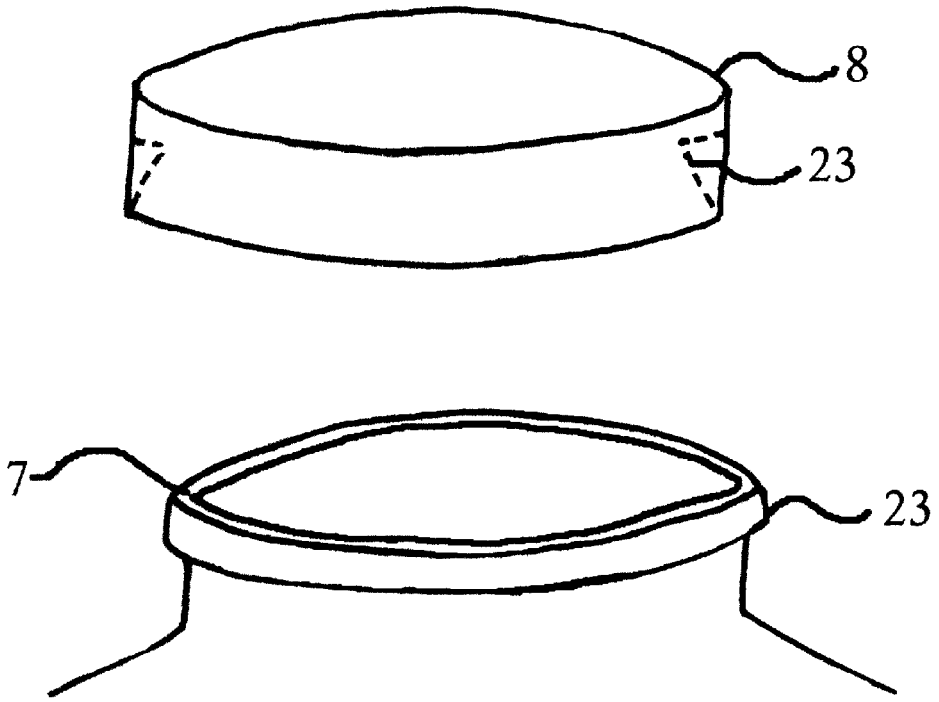
FIG. 11 shows an isometric view of another embodiment of an access element and removably discrete closure element having another embodiment of an axial compression element.

As shown in FIG. 8, certain embodiments of the removably discrete closure invention can be comprise a sliding closure element (18) that can be slidingly engaged with the access element (7) to form a seal. As can be understood the sliding closure element (18) can have a substantially planar surface, but could also have a non-planar surface so long as a portion of the sliding closure element is configured to seal with the access element (7). A guide element can be provided in which the sliding closure element (18) can track and in certain embodiments of the invention provide compressive force between the access element (7) and the sliding closure element (18).

The types of removably discrete closure elements and techniques of using such removably discrete closure elements shown in FIGS. 6–8 are meant to be illustrative of and to provide examples of how to make and use the wide variety of removably discrete closure elements that can be utilized in various embodiments of the invention. These examples are specifically not meant to limit the range of possible closure elements including those that may be interlocking type, snap type, screw type, plug type, friction fit type, sliding type, or other types encompassed within the concept of a removably discrete closure element.

As can be understood from the description and figures numerous embodiments of closure elements (8) that are removably discrete can be utilized in various combinations and permutations with variously configured access elements (7). Each of these various combinations and permutations are explicitly encompassed within this description of the sealably accessible outerwear invention.

The closure element (8) can further comprise a material or object containment element within the closure element (8). In certain embodiments of the invention, the object containment element can comprise the interior volume of the closure element (8) itself. In those embodiments of the invention, the interior volume can be accessed by removing or releasing a portion of the closure element (8) to expose the interior of the closure element (8). This can be accomplished without necessarily removing the closure element (8) from the outerwear (1). Specifically, for example, with respect to embodiments of the invention used to store fishing flys or tackle, a portion of the interior volume of the closure element (8) can be tailored to function as a cushion into which the barbed portion of the hook can be inserted. Certain embodiments of the invention can further include an extendable and retractable tether element (26), further discussed below, to allow the wearer to remove the closure element (8) from the outerwear (1), obtain materials from the containment element, and be assured that the closure element (8) will return to the proximity of the access element (7) by retraction of the tether element (26). Naturally, the interior volume of the containment element can be functionally tailored for the containment or storage of a variety of materials or objects related to the activities for which the outwear can be fashion or is used.

Additionally, the access element (7) and a portion of the inside of the outerwear (1) can be functionally tailored for the containment or storage of a variety of materials or objects related to the activities for which the outerwear can be fashion or is used. Again, as but one example related to outerwear worn by fishermen, the access element (7) and a portion of the inside of the outerwear (1) accessible through the access element (7) can be tailored with cushion material into which the barb of a hook can be inserted.

Now again referring primarily to FIGS. 6 and 7, the sealably accessible outerwear invention can comprise a rotationally operable axial compression element that generates sufficient compression between the closure element (8) and the access element (7) to establish a seal substantially impervious to liquid, if required. As shown in FIG. 6, with respect to some embodiments of the invention, the rotationally operable axial compression element can be a first spiral thread (19) responsive to the closure element (8) and a second spiral thread (19') responsive to the access element (7). The first spiral thread (19) rotationally mates with the second spiral thread (19') to draw the closure element (8) into engagement with the access element (7). Subsequent rotation can develop compressive force between the surfaces of the access element (7) and the closure element (8) configured to engage one another, thereby establishing the desired amount of seal.

As shown in FIG. 7, the mated spiral threads can be coupled to the inside surface of the access element (7) or tubular element (11) rather than the outside of the tubular element when a plug type closure is utilized. Understandably, not all embodiments of the rotationally operable axial compression element comprise spiral threads and additional embodiments of the rotationally operable axial compression element may include, for example, flanges on the closure element that rotationally engaged cam surfaces responsive to the access element or tubular element (11).

Other types of axial compression elements may also be utilized as shown in FIGS. 8–11. These may involve the use of a guide element (20), locking hasps (21), interlocking hooks (22)(22'), or snap type compression elements (23) (23'), as examples of the various types of axial compression elements that are encompassed by the invention.

Figure 12:
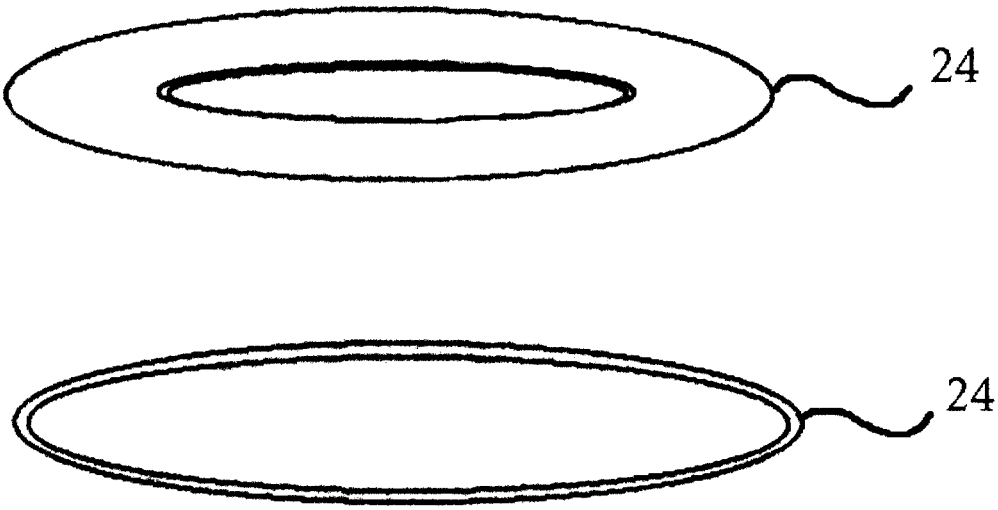
FIG. 12 shows an isometric view of embodiments of discrete conformable seal elements that can be compressed between the access element and the closure element.
Figure 13:
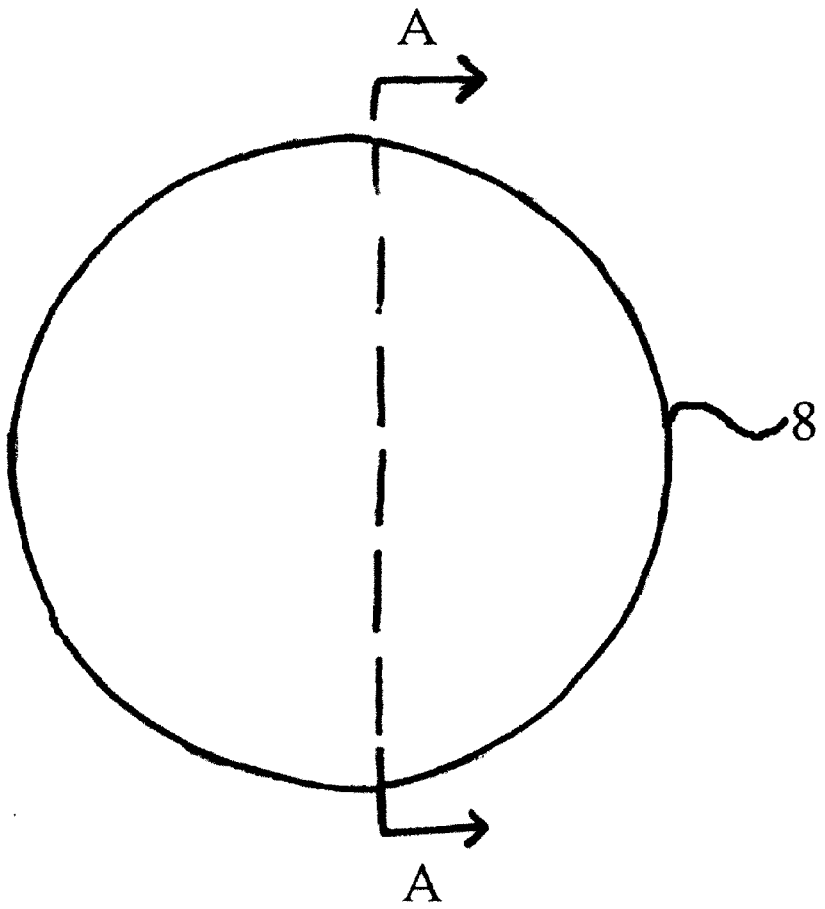
FIG. 13 shows an isometric view of another embodiment of a conformable seal element integral to the access element.
Figure 13:
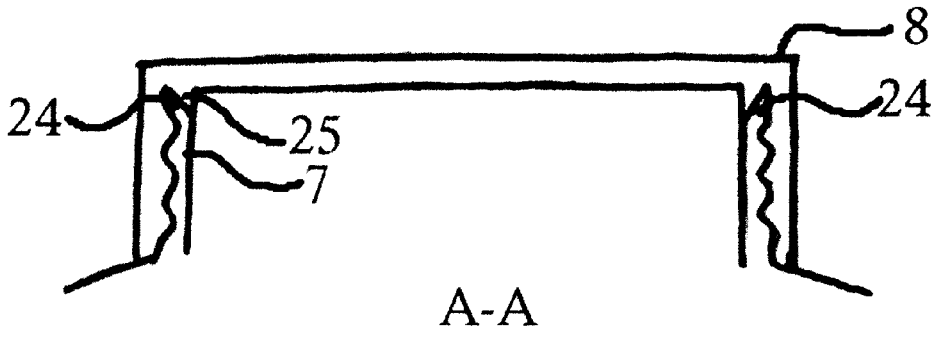

Now referring primarily to FIGS. 12 and 13, the invention can further comprise a discrete seal element (24) responsive to the access element (7) and the closure element (8). The discrete seal element (24) can be a separate component such as the O-ring, or the rubber washer, exemplified by FIG. 12, or can be integral to the access element (7) or the closure element (8) as exemplified by FIG. 13. In the example provided by FIG. 13, the material from which the access element (7) is formed or configured can be softer that the material the closure element (8) is formed or configured from. As such, compression surface (25) can deform the surface of the access element so as to conform to the shape of the compression surface (25). Generally, the discrete seal element (24) conforms to the surface irregularities of mating compression surfaces between the access element (7) and the closure element (8) to affirmatively fill surface irregularities and minimize leakage or make the seal waterproof.

Figure 14:
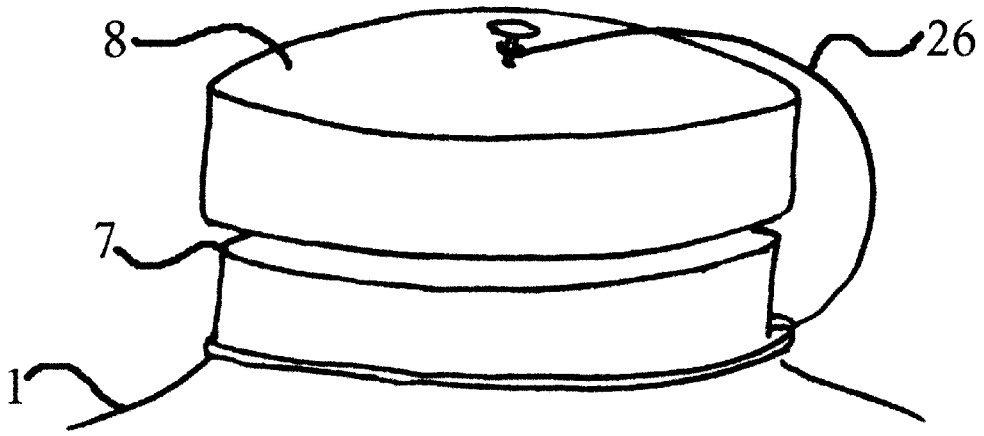
FIG. 14 shows an isometric view of an embodiment of a tether element responsive to the access element and the closure element.

Now referring primarily to FIG. 14, a closure tether element (26) can be utilized to flexibly couple the various embodiments of the removably discrete closure element(s) (8) to the outerwear (1) to prevent loss of the closure element (8) or to facilitate locating the closure element (8). A suitably configured or molded tether element (26) can be made of flexibly resilient material can also assist the wearer of the outerwear in engaging the closure element (8) with the access element (7). The closure tether element (26) can be made of a variety of metals, plastics, or other material that allows the removably discrete closure element (8) to be removed from the access element (7), has sufficient strength to bear the weight of the removably discrete closure element, and allows subsequent engagement of the removably discrete closure element with the access element.

Figure 15:
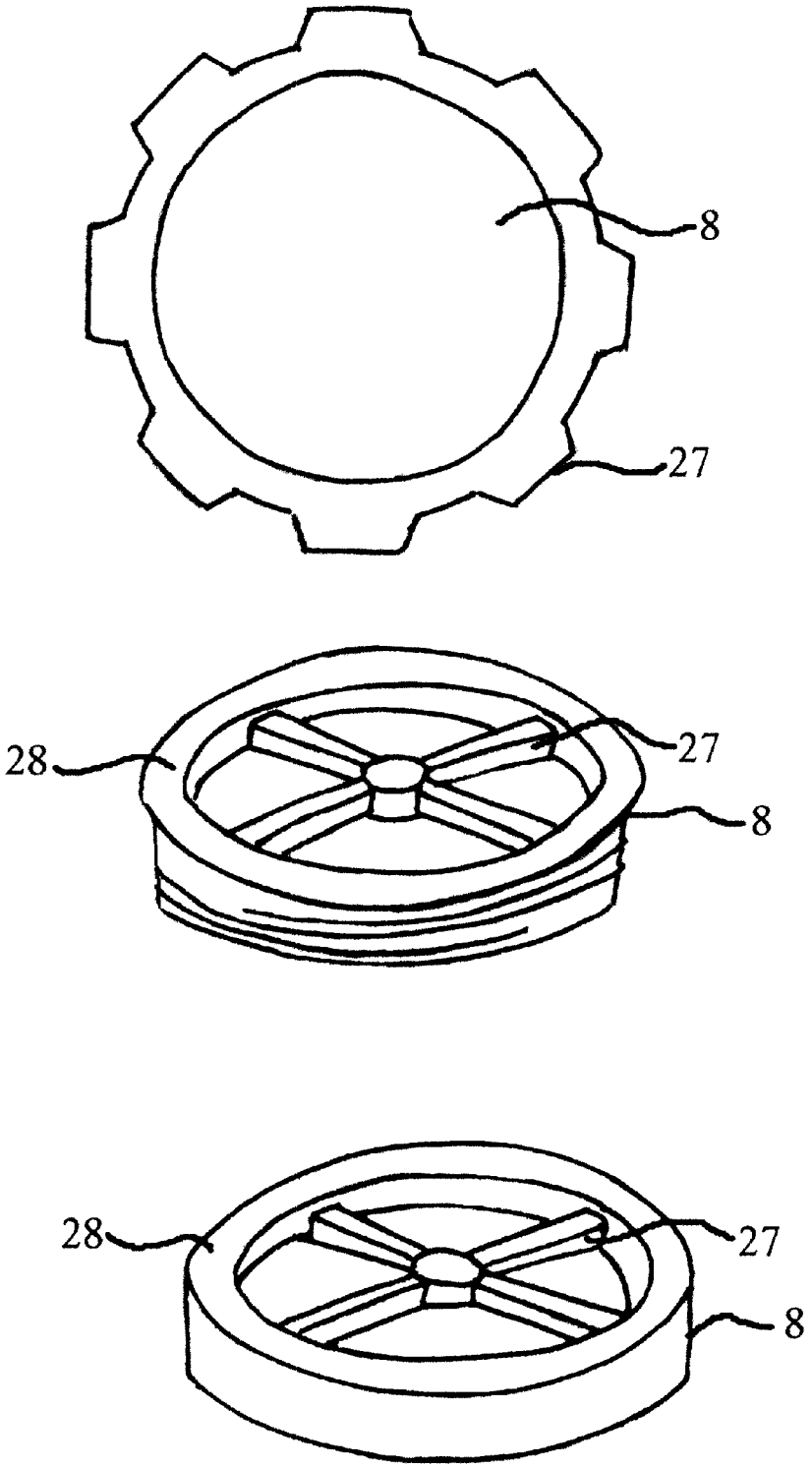
FIG. 15 shows an isometric views of embodiments of removably discrete closure elements each having different embodiments of a friction augmentation surface.
Figure 16:
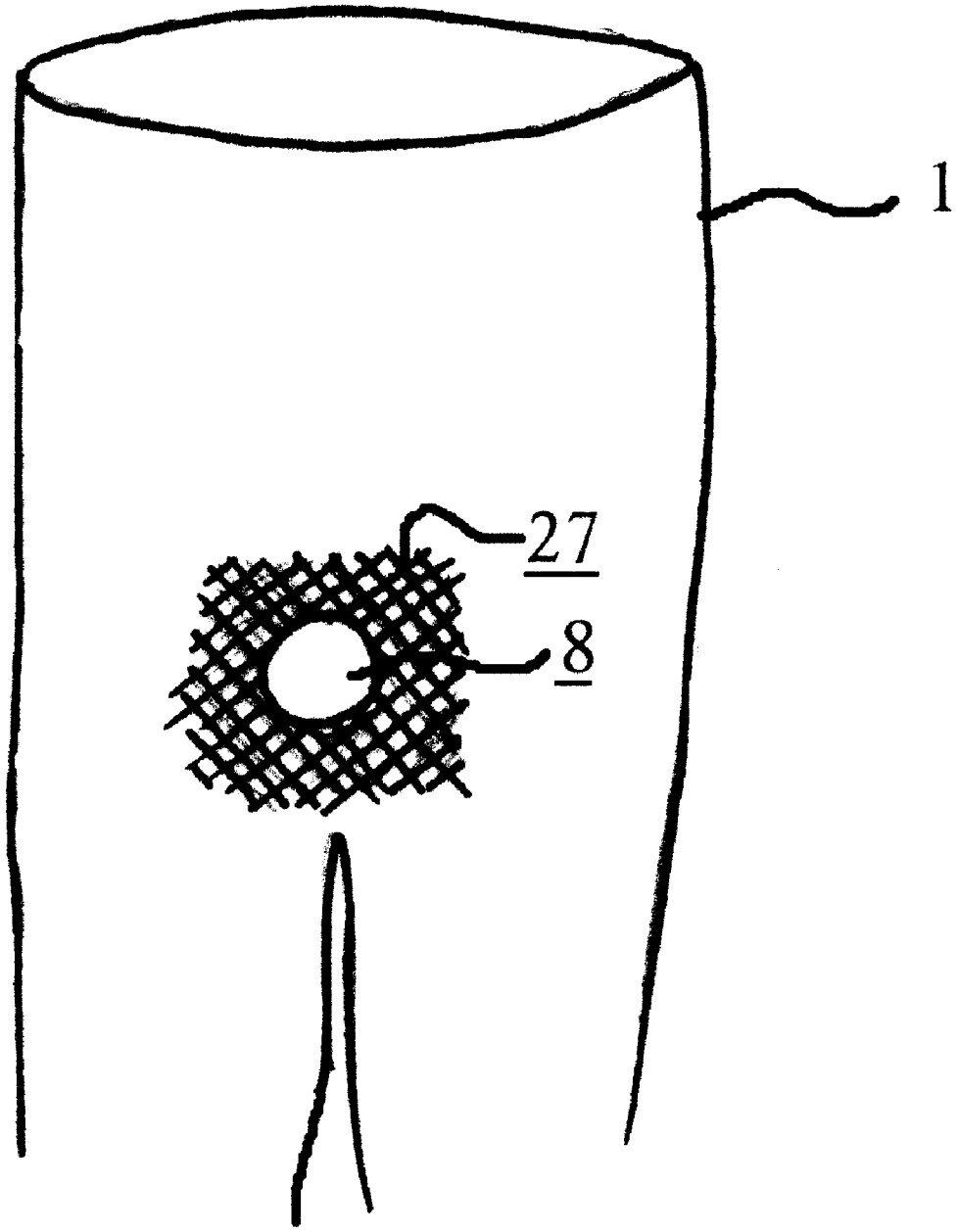
FIG. 16 shows an isometric view of an embodiment of a friction augmentation element having a location in proximity to the access element.

Now referring primarily to FIGS. 15 and 16, the invention may further comprise friction enhancement surface(s) (27) on the closure element (8) or in proximity to the access element (7) to facilitate grip with respect to these components of the invention. The friction enhancement element(s) (27) on the closure element (8) can comprise the teeth about the circumference of the closure element (8) as shown in FIG. 15, but can also comprise raised, embossed, molded, coated, textured or milled aspects coupled to any portion of the surface of the closure element that may provide increased frictional force(s) between the contact portion of the outerwear wearer's hand and that portion of the closure element (8) or access element (7) contacted by the outerwear wearer's hand. Similarly, the friction enhancement element (s) (27) joined to the outside surface of the outerwear in the proximity of the access element (8) can comprise a textured, raised, embossed, or molded elements that provide increased frictional force(s) between the contact portion of outerwear wear's hand and the outerwear (1) itself.

Again referring primarily to FIGS. 15 and 16, visibility enhancement element(s) (28) can be coupled to a portion of or the entirety of the surface of the closure element (8) or to the outside of the outerwear in the proximity of the access element (7), or to the tubular element (11). Visibility enhancement element(s) can comprise colored pigment(s) in the material from which these elements are made or can be applied to the surface, phosphorescent or glow-in-the-dark material(s), reflective material(s), or the like, to facilitate location and engagement of the closure element (8) with the access element (7).

Figure 17:
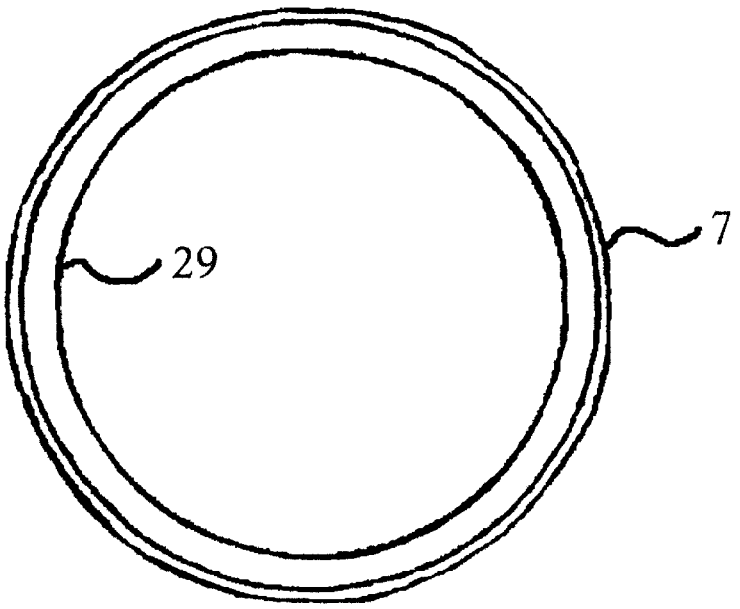
FIG. 17 shows an isometric view of an embodiment of a thermal barrier coupled to the inside surface of an embodiment of a tubular element.
Figure 17:
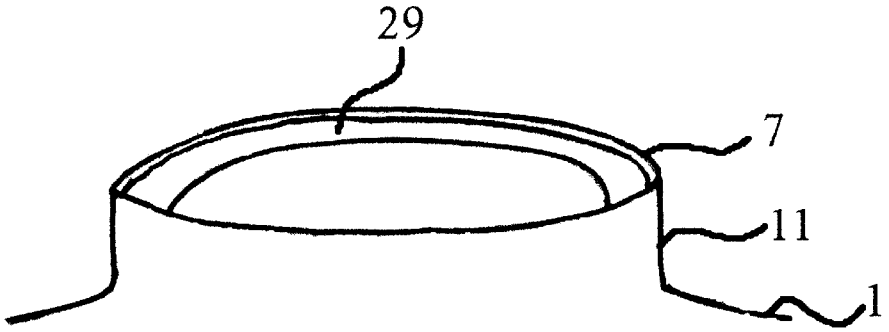

Now referring primarily to FIG. 17, the invention can further comprise a thermal barrier (29) coupled to the closure element (8) or in the proximity of the access element (7) or inside the tubular element (11). The thermal barrier (29) can be any material that provides additional resistance to the transfer of heat away from the inside surface of outwear (1) in the proximity of the access element (8) or the closure element (7). This thermal barrier (25) can be a fabric liner joined to the inside surface of the outerwear (1) in the proximity of the access element (7) or could be a middle layer of material in a multiple layer material having greater resistance to transfer of heat then the surrounding layers.

Figure 18:
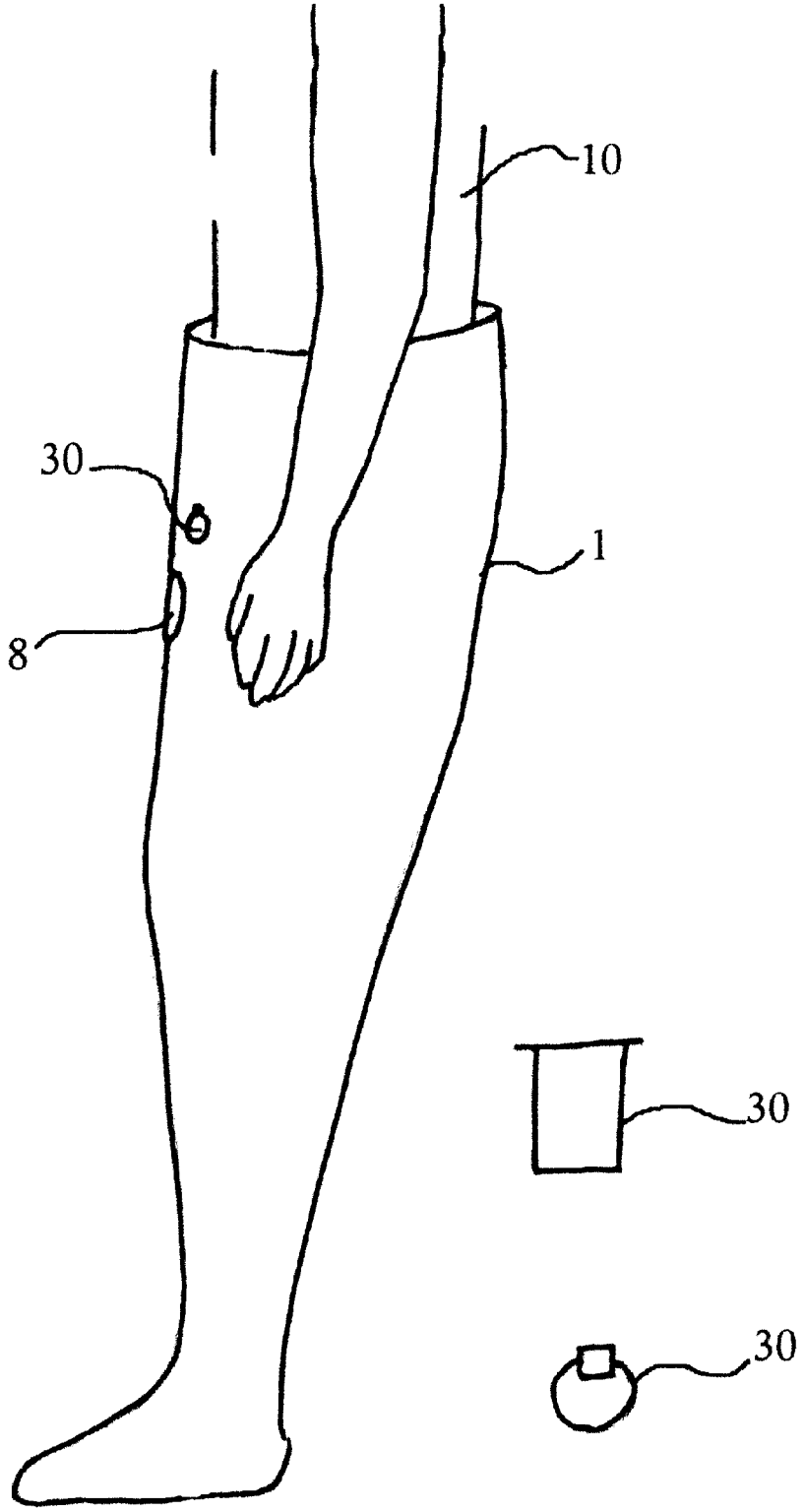
FIG. 18 shows a side view of an embodiment of an access location adjustment element responsive to the access element.

Now referring primarily to FIG. 18, the invention can also comprise a access location adjustment element (30). Certain embodiments of the access location adjustment element (30) can comprise a variety of configurations of ring(s) or tab(s), such as the examples shown by FIG. 18, joined to the outside surface of the outerwear (1). The access location adjustment element (30) can comprise a variety of hardware or material configurations that provide a grip responsive to the outerwear (1) proximate to the access element(7). Movement of the access location adjustment element (30) can thereby result in movement of the access element (7) to the location desired by the wearer (10).

Figure 19:
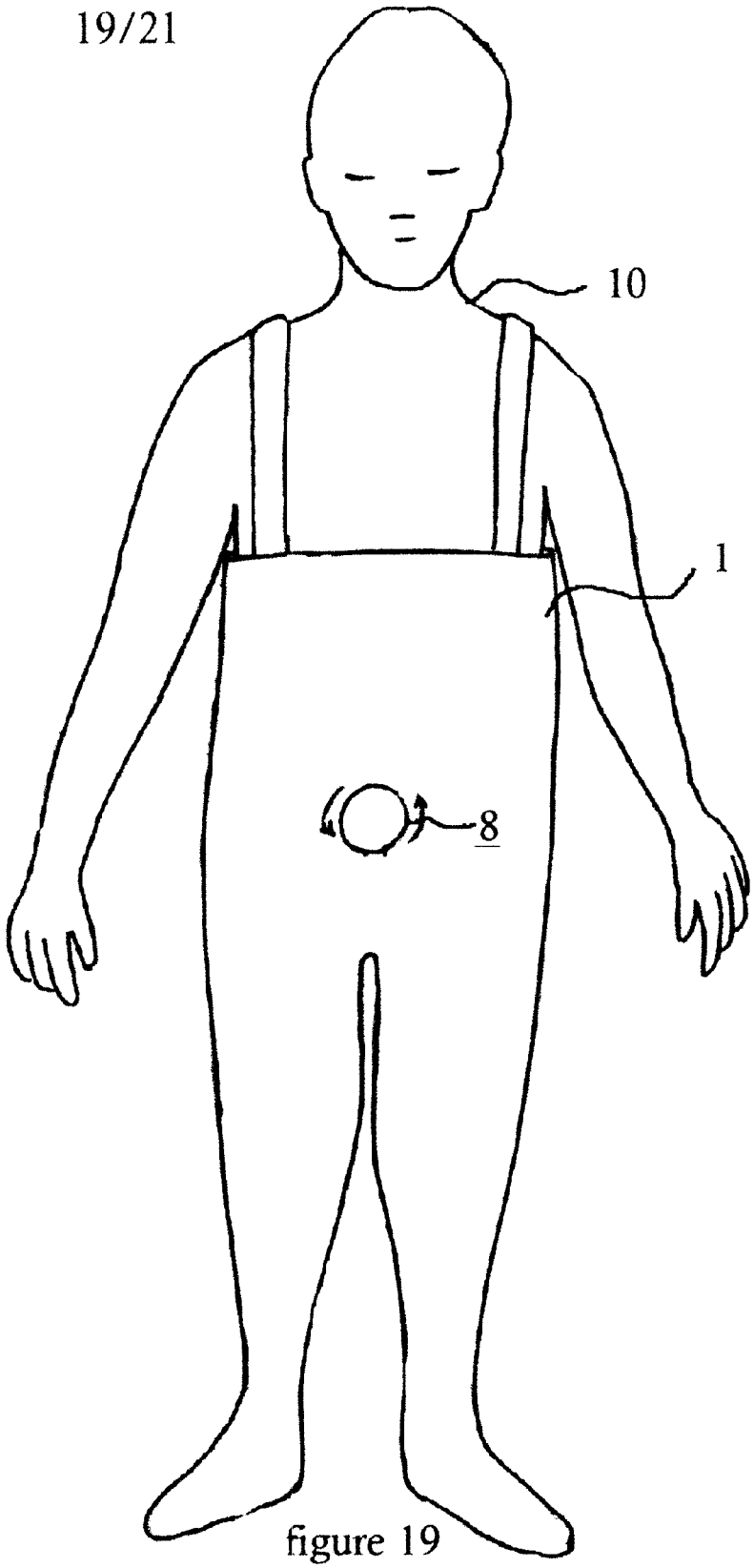
FIG. 19 illustrates how an embodiment of the sealably accessible outerwear invention having an embodiment of an axial compression element can be used by rotation of the closure element to establish the closure element discrete from the access element.
Figure 20:
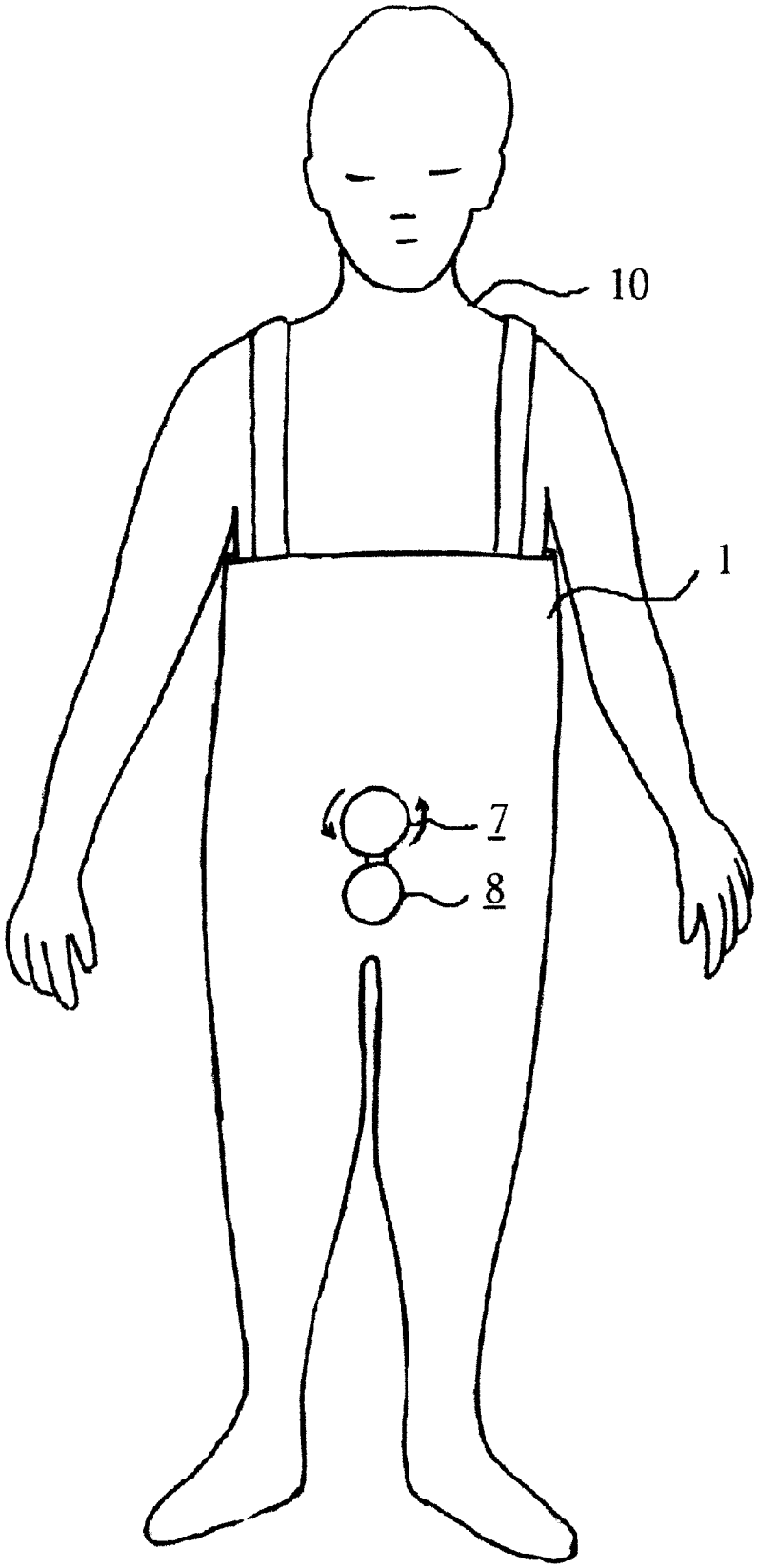
FIG. 20 further illustrates how an embodiment of the sealably accessible outerwear invention having an embodiment of an axial compression element can be used by rotation of the closure element to establish the closure element discrete from the access element.

Now referring primarily to FIGS. 19 and 20, a preferred embodiment of the outerwear invention can be used by establishing a wearer (10) in a wader (1) having an upper body portion configured to terminate at a height between about the waist and about the neck of a human wader wearer. With respect to that embodiment of the invention, the wearer can by locating the access element (7) begin opening the access element (7) by removing the closure element (8) configured to establish a seal with the access element (7). When the closure element (8) is removed it can become discrete from the access element (7). By removing the closure element (8) a conduit between inside of said wader and outside of said wader can be established and used to transfer or extend objects between the inside of the wader to the outside of the wader.

Alternately, with respect to other embodiments of the invention, the closure element (8) can be operated by rotating an axial compression element responsive to the closure element (8) and responsive to the access element (7). Rotating the axial compression element can generate sufficient compression between the closure element (8) and the access element (7) to establish a seal. In some embodiment of the invention, such as waders, the seal can be substantially impervious to liquid.

In some embodiments of the invention, the conduit established between the inside of the wader and the outside of the wader can be used for expelling excretory waste, and in the case of male wearers, the conduit can be positioned for extending a penile organ through the conduit and expelling urine to outside of the outerwear (1) or wader.

Figure 21:
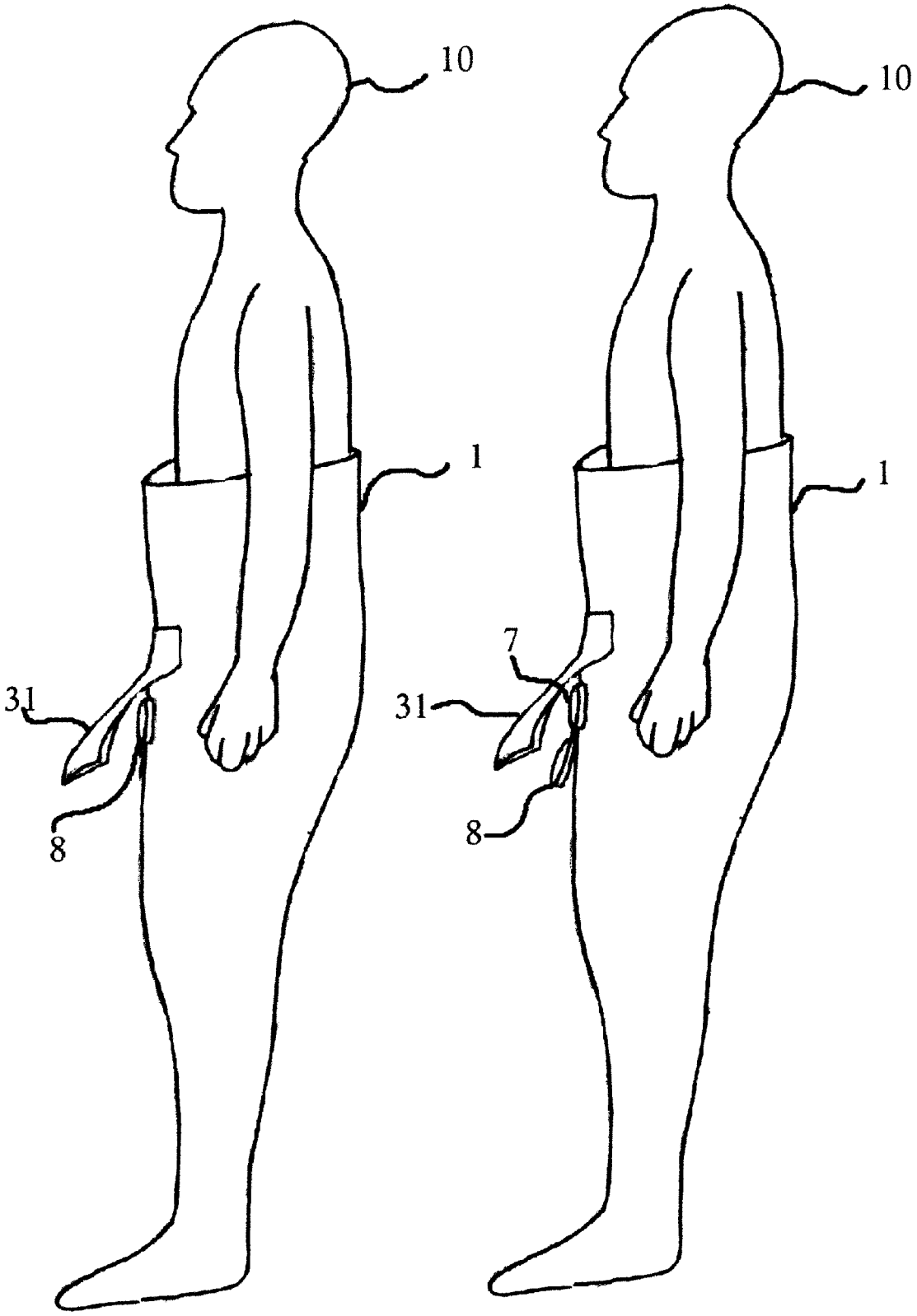
FIG. 21 shows an embodiment of an access element cover.

Now referring primarily to FIG. 21, the invention can further comprise a closure cover (31) coupled to the outside surface of the outwear to cover or conceal the closure element (8). The closure cover (31) can comprise a piece of material from which the outerwear is constructed or other material sized to cover the closure element (8).

As can be easily understood from the foregoing, the basic concepts of the present invention may be embodied in a variety of ways. It involves both techniques to seal accessible outerwear as well as devices to accomplish the appropriate sealing and accessing of outerwear. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this United States Non-provisional patent application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims included in this non-provisional patent application.

It should also be understood that a variety of changes may be made without departing from the essence of the invention. Such changes are also implicitly included in the description and are intended to still fall within the scope of this invention. A broad disclosure encompassing both the explicit embodiment(s) shown, the great variety of implicit alternative embodiments, and the broad methods or processes and the like are encompassed by this disclosure and may be relied upon in supporting the claims.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action that physical element facilitates. Regarding this last aspect, as but one example, the disclosure of a "closure" should be understood to encompass disclosure of the act of "closing"—whether explicitly discussed or not—and, conversely, were there effectively disclosure of the act of "closing", such a disclosure should be understood to encompass disclosure of a "closure" and even a "means for closing" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the Information Disclosure Citation or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have suppport to claim at least: i) each embodiment of the sealably accessible outerwear as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented.

In this regard it should be understood that for practical reasons and so as to avoid adding potentially hundreds of claims, the applicant may present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

I claim:

1. A sealably accessible wader, comprising:

a. a wader, comprising:

i. an upper body portion configured to terminate at about a height between the waist and the neck of a human;

ii. a first leg portion and a second leg portion joined to said upper body portion;

iii. a first foot portion and a second foot portion each joined to a corresponding one of said first leg portion and said second leg portion;

b. a tubular element having a location in the proximity of the crotch area of said wader having a first end that communicates with the inside of said wader and a second end that communicates with the outside of said wader, wherein said tubular element is configured to allow a penile organ to extend through to the outside of said wader;

c. a removably discrete closure element having a surface configured to establish a seal when engaged with said access element;

d. a first spiral thread coupled to said hollow tubular means; and e. a second spiral thread coupled to said surface configured to engage said second end of said hollow tubular element, wherein said first spiral thread and said second spiral thread are rotationally mated.

2. A sealably accessible wader as described in claim 1, wherein said wader comprises a construction substantially impervious to liquid.

3. A sealably accessible wader as described in claim 1, further comprising a closure tether element between said wader and said closure.

4. A sealably accessible wader as described in claim 1, wherein said tubular element has a fixed configuration.

5. A sealably accessible wader as described in claim 4, further comprising a axial collapse element coupled to said tubular element, whereby operation of said axial collapse element provides selectably adjustable length of said tubular element.

6. A sealably accessible wader as described in claim 5, where in said selectably adjustable length of said tubular element allows the exterior surface of said closure to be positioned flush with the exterior surface of said wader.

7. A sealably accessible wader as described in claim 1, further comprising an access location adjustment element responsive to said access element.

8. A sealably accessible wader as described in claim 1, further comprising a thermal barrier coupled to said access element.

9. A sealably accessible wader as described in claim 1, further comprising a thermal barrier coupled to said closure element.

10. A sealably accessible wader as described in claim 1, further comprising a friction enhancement element coupled to said closure element.

11. A sealably accessible wader as described in claim 1, further comprising a friction enhancement element coupled to said access element.

12. A sealably accessible wader as described in claim 1, further comprising a visibility enhancement element coupled to said closure element.

13. A sealably accessible wader as described in claim 1, further comprising a visibility enhancement element coupled to said access element.

14. A sealably accessible wader as described in claim 1, further comprising a discrete seal element responsive to said access element and said closure element.

15. A method of using a wader, comprising the steps of:

a. wearing a wader having an upper body portion configured to terminate at a height between about the waist and about the neck of a human wader wearer;

b. locating an access element on said wader;

c. opening said access element, wherein opening said access element comprises removing a closure element configured to establish a seal with said access element, and wherein said closure element when removed becomes discrete from said access element; and d. establishing a conduit between inside of said wader and outside of said wader.

16. A method of using a wader as described in claim 15, further comprising the step of closing said access element, wherein closing said access element comprises replacing said closure element configured to establish a seal with said access element.

17. A method of using a wader as described in claim 16, further comprising the step of sealing said access element, wherein sealing said access element comprises compressing said closure element and said access element sufficiently to establish a seal substantially impervious to liquid.

18. A method of using a wader as described in claim 15, further comprising the step of transferring at least one object from inside of said wader to outside of said wader through said conduit.

19. A method of using a wader as described in claim 15, further comprising the step of transferring said at least one object from outside of said wader to inside of said wader through said conduit.

20. A method of using a wader as described in claim 19, further comprising the step of providing a enclosure inside of said wader to contain said at least one object.

21. A method of using a wader as described in claim 15, further comprising the step of expelling excretory waste through said conduit.

22. A method of using a wader as described in claim 15, wherein said human wader wearer comprises a male human wader wearer.

23. A method of using a wader as described in claim 22, wherein said step of expelling excretory waste through said conduit comprises:

i. extending a penile organ through said conduit; and ii. expelling urine from said penile organ extended through said conduit.

24. A method of using a wader as described in claim 23, further comprising the step of configuring said access element to further comprise a tubular element.

25. A method of using a wader as described in claim 24, further comprising the step of coupling an axial collapse element to said tubular element.

26. A method of using a wader as described in claim 25, further comprising the step of adjusting the length of said tubular element by operation of said axial collapse element.

27. A method of using a wader as described in claim 26, further comprising the step of withdrawing said penile organ inside said wader.

* * * * *